United States Patent [19]

Couper et al.

[11] 4,146,457

[45] Mar. 27, 1979

[54] DIAPHRAGM CELLS

[75] Inventors: Aitken M. Couper; Peter J. Davies; Janusz J. H. Krause, all of Runcorn, England

[73] Assignee: Imperial Chemical Industries Limited, London, England

[21] Appl. No.: 848,718

[22] Filed: Nov. 4, 1977

[30] Foreign Application Priority Data

Nov. 12, 1976 [GB] United Kingdom ..... 47210/76

[51] Int. Cl.[2] ..... C25B 1/16; C25B 1/26; C25B 9/02; C25B 9/04

[52] U.S. Cl. ..... 204/252; 204/279; 204/282; 204/283; 204/288; 204/289

[58] Field of Search ..... 204/279, 282, 283, 289, 204/252, 253, 288

[56] References Cited

U.S. PATENT DOCUMENTS

| | | | |
|---|---|---|---|
| 2,485,076 | 10/1949 | Timerman | 204/279 X |
| 2,735,812 | 2/1956 | Van Hoek | 204/279 X |
| 3,873,437 | 3/1975 | Pulver | 204/282 X |
| 3,878,082 | 4/1975 | Gokhale | 204/282 X |
| 3,960,697 | 6/1976 | Kircher et al. | 204/252 |
| 3,975,255 | 8/1976 | Kircher | 204/252 |
| 4,032,423 | 6/1977 | Cunningham | 204/289 X |

*Primary Examiner*—Arthur C. Prescott
*Attorney, Agent, or Firm*—Cushman, Darby & Cushman

[57] ABSTRACT

A device for supporting a sheet diaphragm on to a surface of a cathode which is made of a flexible insulating material and which can be caused or allowed to expand into the space between the anode and the diaphragm so that the diaphragm is pressed into contact with the cathode.

18 Claims, 2 Drawing Figures

DIAPHRAGM CELLS

Figure 1:
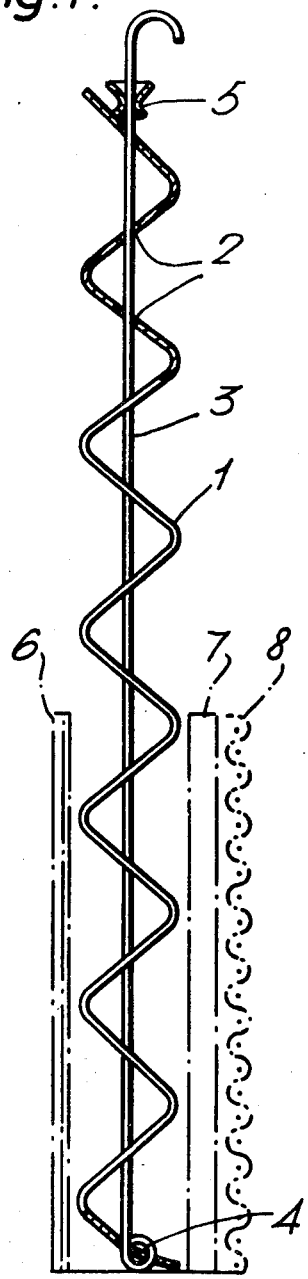

This invention relates to improvements in electrolytic diaphragm cells.

More particularly, it relates to electrolytic diaphragm cells having anodes made from a film-forming metal and which carry an electrocatalytically-active coating. It especially relates to diaphragm cells for the electrolysis of aqueous solutions of alkali-metal halides.

A wide variety of diaphragm cells are known which consist in principle of a series of anodes and a series of cathodes disposed in a parallel alternating manner and separated from each other by a substantially vertical diaphragm. In cells of recent design, the anodes are suitably in the form of plates of a film-forming metal (usually titanium) and carry an electrocatalytically-active coating (for example a platinum metal oxide); the cathodes are suitably in the form of a perforated plate or gauze of metal (usually mild steel); and the diaphragms which are usually fitted to the surface of the cathodes are suitably in the form of sheets of asbestos or of a synthetic organic polymeric material, for example polytetrafluoroethylene or polyvinylidene fluoride.

In operating a diaphragm cell, there is a tendency for diaphragms to become detached from the cathode surface, for example because of expansion of the sheet diaphragm during warming-up of the cell. Such a detachment of the diaphragm can result in a reduction in or partial blockage of the anolyte recirculation space between the diaphragm and the anode and/or trapping of gas generated at the cathode (e.g., hydrogen in a chlorine/caustic soda cell) between the diaphragm and the cathode.

We have now devised a device for supporting diaphragms in close contact with cathodes which aims to obviate or mitigate the aforesaid disadvantages.

The present invention provides a device for supporting a sheet diaphragm on to the surface of a cathode in an electrolytic diaphragm cell which cell also comprises an anode spaced apart from the cathode, characterized in that the device is made of a flexible insulating material which has dimensions which permit it to be placed in the cell in the space between the anode and the diaphragm and which is capable of being caused or allowed to expand into the said space so as to bear upon the surfaces of the anode and the diaphragm, thereby pressing the diaphragm into contact with the surface of the cathode.

According to another aspect of the invention we provide an electrolytic cell comprising an anode spaced apart from a cathode and a sheet diaphragm separating the anode and cathode and which further comprises a device for supporting the diaphragm on the surface of the cathode, characterized in that the device is made of a flexible insulating material which has dimensions which permit it to be placed in the cell in the space between the anode and the diaphragm and which is capable of being caused or allowed to expand into the said space so as to bear upon the surfaces of the anode and the diaphragm, thereby pressing the diaphragm into contact with the surface of the cathode.

The supporting device is preferably mounted on a central support, for example a rod or a wire.

The supporting device may, for example, be in the form of a coiled strip of a flexible insulating material. Before assembling into the cell, the strip may conveniently be coiled tightly on to a suitable support, for example a rod or a wire. The coiled strip and support are then inserted into the space between the anode and the diaphragm and the coiled strip is released so that it expands laterally and engages the opposing surfaces of the diaphragm and the anode, thereby pressing the diaphragm into contact with the anode surface. The central support may then be removed if desired. Alternatively, the central support may be retained in position whilst the coiled strip is in the cell. When it becomes necessary to remove the coiled strip from the cell, the coil may be partially uncoiled by pulling the strip along its support so that the coiled strip may be removed from the cell without causing any damage to the diaphragm.

In a preferred embodiment of the invention, however, the supporting device comprises a foldable strip mounted upon a central support, which strip when inserted in the space between the diaphragm and the anode of the cell is substantially parallel to the diaphragm and anode, and wherein the strip is compressible relative to the support so that on compressing it expands laterally and bears on the surface of the anode and the diaphragm.

The preferred embodiment is conveniently in the form of a strip of flexible material having a plurality of holes along its longitudinal axis through which the central support, for example a rod or a wire, can be threaded.

The end of the strip, corresponding to the lower end when the member is inserted into the cell, is suitably attached to the support, thereby enabling the other end of the strip to be pushed or pulled along the support. The strip may be retained in any desired position along the rod by any convenient clamping means.

The flexible insulating material comprising the supporting member is preferably of a synthetic organic polymer, for a example a fluorinated organic polymer such as polytetrafluoroethylene or polyvinylidene fluoride.

When a central support rod is used in conjunction with the supporting device, it is made of a film-forming metal (titanium, zirconium, niobium, tantalum, tungsten) or an alloy thereof. It is especially preferred to use supports of titanium or titanium alloys.

The supporting device according to the invention has several advantages. It can be inserted once the cell has been assembled, results in firm but gentle pressure on the diaphragm and causes little or no damage to the diaphragm, allows for variations in anode/cathode gap because of its flexibility, and occupies only a small fraction of the available area of the diaphragm.

The invention is especially applicable to diaphragm cells for the manufacture of chlorine and alkali metal hydroxides by electrolysis of aqueous alkali metal chloride solutions, for example in diaphragm cells manufacturing chlorine and sodium hydroxide from sodium chloride solutions.

The invention is further illustrated by reference to the accompanying drawings in which FIG. 1 is a diagrammatic end view of a diaphragm-supporting device in the form of a foldable strip mounted on a central support wire and shows the device when inserted into a diaphragm cell whilst still in its expanded (laterally compressed) position.

Figure 2:
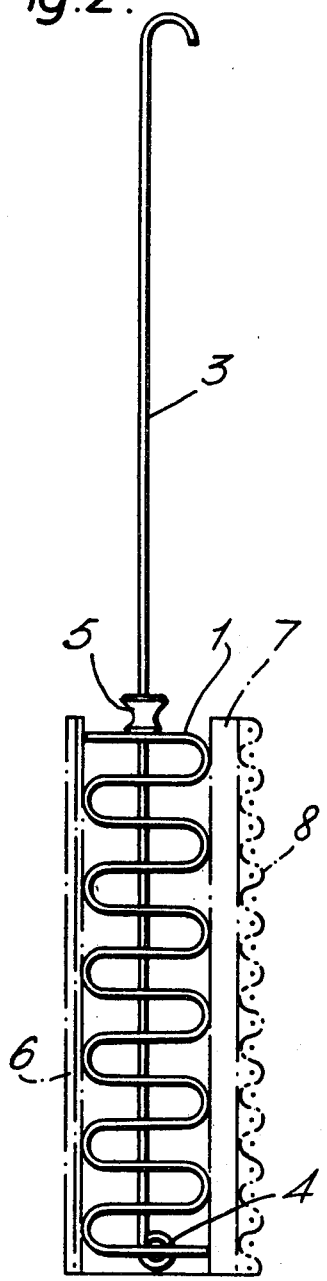

FIG. 2 is a diagrammatic end view of the device of FIG. 1 in the diaphragm cell showing the device in its compressed (laterally expanded) position.

Referring to the drawings, the diaphragm supporting device comprises a strip of flexible polymer 1, for example of polytetrafluoroethylene or polyvinylidene fluoride, suitably about 1 cm wide, which is provided with a plurality of holes 2 through which is threaded a titanium wire 3. The strip 1 is attached to the wire 3 at 4. A clamping clip 5 is provided to limit a longitudinal movement of the strip 1 along the wire 3.

Before assembling the supporting device into a diaphragm cell, the slip 5 is released and the strip is pulled along the wire into a longitudinally expanded position (as shown in FIG. 1). The supporting device is then inserted into a diaphragm cell (shown in FIGS. 1 and 2) comprising an anode 6 (e.g., a titanium anode coated with an electrocatalytically active coating such as a mixture of ruthenium oxide and titanium dioxide), a diaphragm 7 (e.g., of asbestos, polytetrafluoroethylene or polyvinylidene fluoride) and a cathode 8 (e.g., of mild steel gauze). The clip 5 is then released and the strip is pushed down until it is laterally urged into engagement with the surfaces of the anode 6 and the diaphragm 7, thereby pressing the diaphragm onto, and maintaining it in contact with, the cathode 8.

What we claim is:

1. An electrolytic cell comprising an anode spaced apart from a cathode and a sheet diaphragm separating the anode and cathode and which further comprises a device for supporting the diaphragm on the surface of the cathode, characterized in that the device is made of a flexible insulating material which has dimensions which permit it to be placed in the cell in the space between the anode and the diaphragm and which is capable of being caused or allowed to expand into the said space so as to bear upon the surfaces of the anode and the diaphragm, thereby pressing the diaphragm into contact with the surface of the cathode.

2. An electrolytic cell as in claim 1 wherein the said supporting device is mounted on a central support.

3. An electrolytic cell as in claim 2 wherein said central support is a rod or a wire.

4. An electrolytic cell as in claim 1 wherein said supporting device comprises a coiled strip.

5. An electrolytic cell as in claim 2 wherein said supporting device comprises a foldable strip mounted upon a central support, which strip when inserted in the space between the diaphragm and the anode of the cell is substantially parallel to the diaphragm and the anode, and wherein the strip is compressible relative to the support so that on compressing it expands laterally and bears on the surface of the anode and the diaphragm.

6. An electrolytic cell as in claim 1 wherein said flexible insulating material is a fluorinated organic polymer.

7. An electrolytic cell as in claim 6 wherein the fluorinated polymer is polytetrafluoroethylene or polyvinylidene fluoride.

8. An electrolytic cell as in claim 3 wherein said central support is made of a film-forming metal or an alloy thereof.

9. An electrolytic cell as in claim 8 wherein said central support is made of titanium.

10. A device for supporting a sheet diaphragm on to the surface of a cathode in an electrolytic diaphragm cell which cell also comprises an anode spaced apart from the cathode, characterized in that the device is made of a flexible insulating material which has dimensions which permit it to be placed in the cell in the space between the anode and the diaphragm and which is capable of being caused or allowed to expand into the said space so as to bear upon the surfaces of the anode and the diaphragm, thereby pressing the diaphragm into contact with the surface of the cathode.

11. A device as claimed in claim 10 whenever mounted on a central support.

12. A device as claimed in claim 11 wherein the central support is a rod or a wire.

13. A device as claimed in claim 12 wherein the central support is made of a film-forming metal or an alloy thereof.

14. A device as claimed in claim 13 wherein the central support is made of titanium.

15. A device as claimed in claim 11 which comprises a foldable strip mounted upon a central support, which strip when inserted in the space between the diaphragm and the anode of the cell is substantially parallel to the diaphragm and the anode, and wherein the strip is compressible relative to the support so that on compressing it expands laterally and bears on the surface of the anode and the diaphragm.

16. A device as claimed in claim 10 which comprises a coiled strip.

17. A device as claimed in claim 10 wherein the flexible insulating material is a fluorinated organic polymer.

18. A device as claimed in claim 17 wherein the fluorinated polymer is polytetrafluoroethylene or polyvinylidene fluoride.

* * * * *